United States Patent [19]

Del Fabbro

[11] Patent Number: 4,909,236

[45] Date of Patent: Mar. 20, 1990

[54] GAS CONVECTION OVEN AND MODULE THEREOF COMPRISING A HEAT EXCHANGER

[75] Inventor: Claudio Del Fabbro, Porcia, Italy

[73] Assignee: Zanussi Grandi Impianti S.p.A., Pordenone, Italy

[21] Appl. No.: 360,032

[22] Filed: Jun. 1, 1989

[30] Foreign Application Priority Data

Jun. 1, 1988 [IT] Italy ..... 45731 A/88

[51] Int. Cl.[4] ..... F24C 15/32

[52] U.S. Cl. ..... 126/21 A; 126/91 A

[58] Field of Search ..... 126/21 A, 21 R, 273 R, 126/273 A, 91 A

[56] References Cited

U.S. PATENT DOCUMENTS 4,648,377 3/1987 Van Camp ..... 126/21 A

*Primary Examiner*—Carroll B. Dority

*Attorney, Agent, or Firm*—Wenderoth, Lind & Ponack

[57] ABSTRACT

A gas convection oven includes a blower and a heat exchanger which together produce a circulation of hot air through a cooking portion of the oven at a uniform speed and with a uniform temperature distribution. The heat exchanger includes a plurality of generally U-shaped tubes disposed outwardly of the blower and uniformly spaced apart in a symmetrical relationship concentric to the blower. Each of the tubes has a first end in open communication with a first collector chamber in which hot combustion gases are generated by a gas burner and a second end in open communication with a second collector chamber. An exhaust device is connected to the collector chamber for exhausting combustion gases generated by the gas burner from the oven via the second collector chamber and the tubes of the heat exchanger. The exhaust device may in turn include an ejector for aspirating the exhaust from the oven through an exhaust pipe open to the second collector chamber.

17 Claims, 5 Drawing Sheets

GAS CONVECTION OVEN AND MODULE THEREOF COMPRISING A HEAT EXCHANGER

BACKGROUND OF THE INVENTION

The present invention relates to a gas convection oven comprising a heat exchanger for heating forced air in the convection oven in a manner which allows a uniform temperature distribution within the cooking portion of the oven.

Known gas convection ovens include a dividing wall defining a cooking portion of the oven, a blower disposed against the dividing wall and driven by an electric motor, and a heat exchanger over which air forced from the blower passes. The heat exchanger generally comprises a plurality of vertically extending rectilinear pipes disposed close to the blower. A gas burner is disposed below and is separated from the cooking portion of the oven and generates hot combustion gases which rise through the pipes of the heat exchanger. A flue is defined in the oven above and is connected to the pipes of the heat exchanger so as to exhaust the combustion gases to the outside of the oven.

Another gas convection oven is known in which the tubes of the heat exchanger have a semi-circular shape and laterally surround the blower.

However, these conventional gas convection ovens have the following disadvantages.

First, because the tubes of the heat exchangers are disposed at different distances from the circumferences of the blowers, it is not possible to obtain a flow of hot air in each prior art oven that has a uniform speed and temperature, and thus, a flow of hot air having a uniform temperature distribution cannot be uniformly distributed about the cooking portion of the oven. Accordingly, a satisfactory cooking of food supported at various levels in the cooking portion of the oven cannot be carried out.

Furthermore, another factor which contributes to the uneven cooking of foods in these conventional ovens is that there is an uneven distribution of thermal energy radiating along the vertically extending tubes of the heat exchanger since the heated combustion gases progressively cool as the same pass upwardly through the tubes in the oven.

Finally, because of the presence of the fume discharge flue defined at the top of the cooking portion of the oven and the combustion chamber extending from an area defined below the cooking portion of the oven, the ovens cannot be adapted for use in series with each other.

SUMMARY OF THE INVENTION

Accordingly, an object of the present invention is to overcome the disadvantages in the prior art cooking ovens by providing a convection oven having a heat exchanger which is configured to facilitate a homogenous heating of food to be cooked in the oven and which can output a high thermal yield.

More specifically, an object of the present invention is to provide a gas convection oven comprising a movable metallic casing having a dividing wall therein which divides the casing into cooking portion and a heating element-receiving portion, a dividing wall defining openings which place the cooking portion and the heating element-receiving portion in an air-circulatable relationship, a gas burner in the heating element-receiving portion for generating hot combustion gases, a blower in the heating element-receiving portion for forcing air to circulate between the portions of the casing, an electric motor disposed in the heating element-receiving portion of the casing and connected to the blower for driving the same, a heat exchanger disposed in the heating element-receiving portion for heating the air circulating between the portions of the casing with heat from the hot combustion gases, and an exhaust device for exhausting the combustion gases from the oven.

The heat exchanger comprises a plurality of generally U-shaped tubes uniformly spaced apart in a symmetrical relationship concentric to the blower. The tubes have first and second ends which are respectively connected to at least a first collector chamber and a second collector chamber which extend concentrically to each other and communicate, respectively, with the gas burner and the exhaust device.

A further object of the present invention is to provide a module of a gas convection oven in which various ones of the above-described components can be integrated and tested prior to their incorporation in the oven.

BRIEF DESCRIPTION OF THE DRAWINGS

The present invention will be better understood by reviewing the following detailed description of the preferred embodiments, which are set forth as illustrative of the present invention but not limitative thereof, and which embodiments are shown in the accompanying drawings in which.

DETAILED DESCRIPTION OF THE PREFERRED EMBODIMENTS

Figure 1:
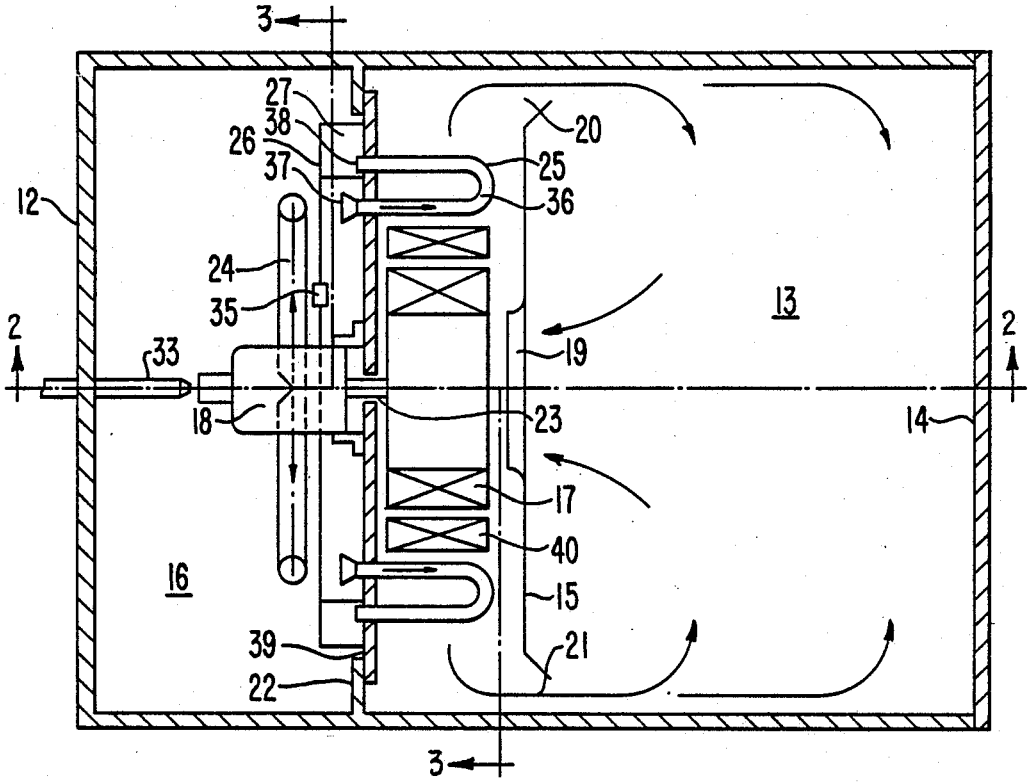
FIG. 1 is a schematic plan view, in section, of a gas convection oven according to a first embodiment of the present invention.
Figure 2:
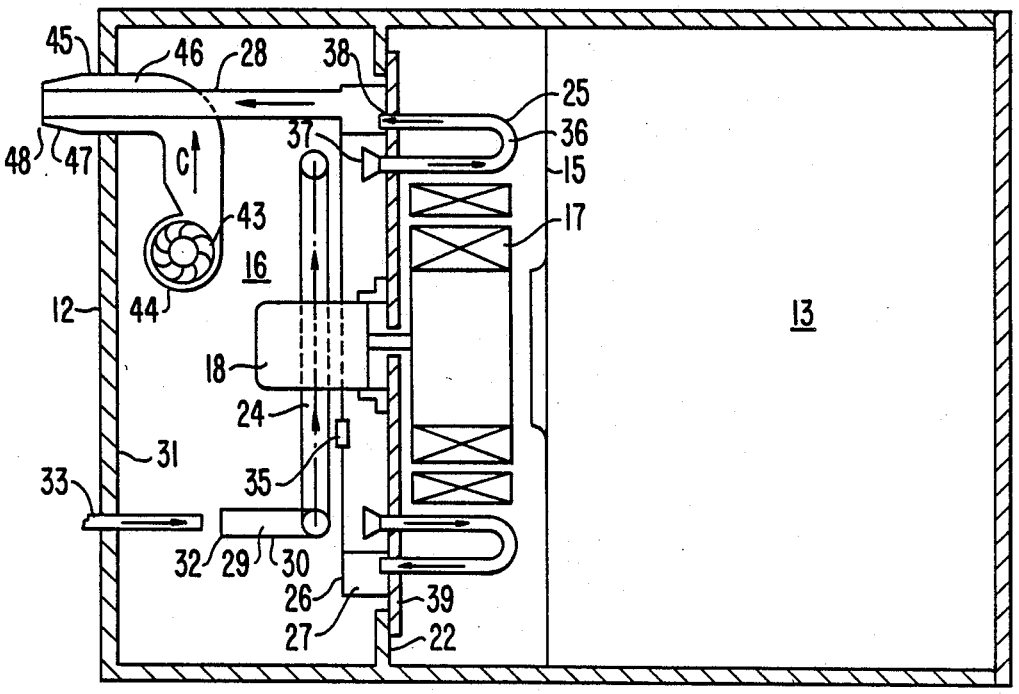
FIG. 2 is a schematic side view of the convection oven shown in FIG. 1 as taken along the line 2—2.

Now referring to FIGS. 1 and 2 illustrating a preferred embodiment of the present invention, a gas convection oven according to the present invention includes a movable metallic casing 12 having a vertically extending dividing wall 15 disposed therein that divides the casing into a cooking portion 13 in which food is to be cooked in the oven and a heating element-receiving portion 16. The cooking portion 13 of the casing can be hermetically sealed by a front oven door 14 and is provided therein with means (not shown) for supporting food therein at a plurality of superposed levels. A blower means 17 (blower) and an electric motor 18 operatively connected thereto are disposed in the heating element-receiving portion 16 of the casing.

The dividing wall 15 defines a plurality of openings 19, 20 and 21 through which the cooking portion 13 and the heating element-receiving portion 16 of the casing are placed in an air-circulatable relationship as shown by the arrows in FIG. 1. In particular, the dividing wall 15 has a curved rim protruding therefrom which defines the opening 19 extending therethrough, and the sides of the dividing wall 15 are spaced from the casing of the oven so as to define openings 20 and 21 which extend the entire height of the cooking portion 13 of the casing.

The casing 12 is also provided with a support wall 22 which extends vertically within the heating element-receiving portion 16. The support wall 22 extends, at least in part, vertically within the casing. The support wall 22 supports at least the blower means 17 and motor 18 operatively connected to the blower means via a drive shaft 23 of the blower means in the oven, and positions these elements within the casing such that the blower means 17 is disposed between the support wall 22 and the dividing wall 15 at a location confronting the central opening 19 defined by the dividing wall 15.

The support wall 22 of the casing 12 also supports, in the oven, at least one gas burner 24 for burning gas to generate hot combustion gases which are discharged from the casing, and a heat exchanger 25 through which the hot combustion gases pass toward the exterior of the casing while being used to heat the air circulated by the blower means 17 and thus cook food within the cooking portion 13 of the casing 12.

Specifically, a generally annular first collector chamber 24 comprises the gas burner, preferably in the form of a circular pipe that distributes the gas and thus the combustion gases over an annular zone in the oven, and is disposed around the drive motor 18 of the blower means 17. A second generally annular collector chamber 26, preferably a circular pipe 27, is disposed concentrically around the first collector chamber 24. An exhaust pipe 28 extends linearly from the second collector chamber 26 for discharging combustion gases generated by the gas burner 24 to the exterior of the oven.

The first generally annular collector chamber also includes a pipe 29 extending from and in communication with the circular pipe thereof, the pipe 29 including a horizontally extending linear portion 30.

The generally annular first collector chamber 24 comprising the gas burner is connectable to a source of gas via a gas feed system (not shown) via another pipe 33 threaded in and extending through the rear wall 31 of the casing 12 for introducing gas to the gas burner.

Figure 3:
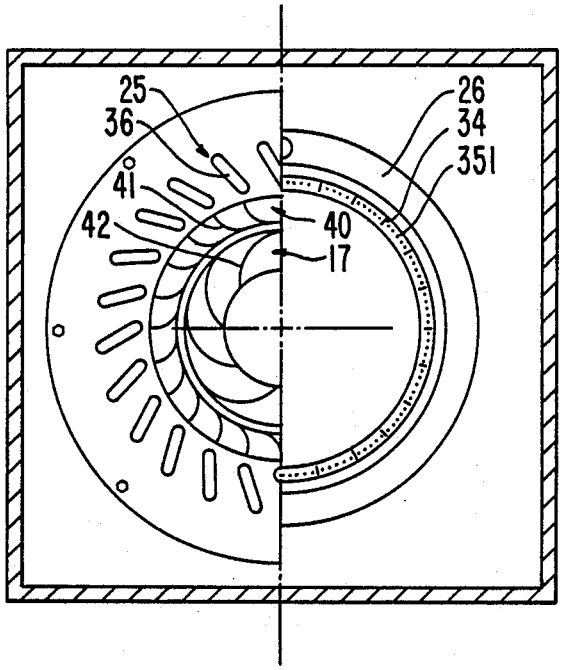
FIG. 3 is a schematic front elevation view of the convection oven shown in FIG. 1 as taken along the line 3—3.

As seen in FIG. 3, the first collector chamber defines a plurality of openings 34 of the gas burner uniformly distributed over the entire circumference thereof and facing the support wall 22 of the casing. These openings 34 are operatively associated with a conventional lighting device 35 capable of simultaneously lighting gas passing through all of the openings 34 so as to provide main flames. The first collector chamber 24 also defines further openings 351 in which secondary flames may be produced.

The heat exchanger 25 comprises a plurality of generally U-shaped tubes 36 which are disposed radially outwardly of the blower means 17 adjacent the circumference thereof, and are uniformly spaced apart in a symmetrical relationship concentric to the blower means 17. Each of the tubes 36 of the heat exchanger 25 has a first end 37 in open communication with the first collector chamber 24 via a small interval provided between the first end of the tube and the gas burner, and a second end 38 in open communication with the circular pipe 27 of the second collector chamber 26. The tubular pipes 36 are supported directly in the oven by the support wall 22 in the casing 12 with the first 37 and second 38 ends thereof extending through the support wall 22. As shown in the figures, the support wall 22 can be formed by a separate mounting wall 39 which is attached to the casing at a support portion (flange) thereof, the mounting wall having corresponding openings through which the ends 37, 38 of the pipes 36 extend whereby the heat exchanger is mounted to the mounting wall 39. Furthermore, the blower means 17, electric motor 18 and first and second collector chambers 24, 26 can be mounted to the mounting wall 39.

In this way the mounting wall 39 and components mounted thereto can form a single module which can be tested before it is provided in the oven.

Referring again to FIG. 3, the tubes 36 of the heat exchanger 25 are supported in the casing 12 on the support portion 22 thereof in such a way that the legs of the tubes extend parallel to each other in an axial direction while being disposed in planes inclined relative to a radially outward direction with respect to the blower means 17, the degree of inclination varying about the blower means 17.

As also seen in FIG. 3, a circular diffuser 40 is provided between the blower means 17 and the tubes 36 of the heat exchanger 25 for diffusing air forced outwardly by the blower means 17 over the tubes 36 of the heat exchanger 25. The diffuser is supported in the casing via the support wall 22 and has a plurality of wings 41 distributed uniformly about the blower means 17. The inclination of the blades 42 of the blower means relative to a radially outward direction with respect to the blower means is different from the inclination of the wings 41 of the diffuser 40, e.g. while the blades 41 are inclined in one of a clockwise and a counterclockwise direction (clockwise in the figure) relative to a radially outward direction with respect to the blower means, the wings 41 of the diffuser 40 are inclined in the other of the clockwise and counterclockwise directions.

The wings 41 cause a reduction in the speed of the air forced outwardly by the blower means 17 and also control the pressure of the air to be more uniform as the air passes over the tubes 36 of the heat exchanger 25, whereby the air is heated by the hot combustion gases passing through the tubes 36.

In this way, due to the symmetrical geometric relationship between the tubes 36, the blower means 17, and the circular diffuser 40, it is possible to generate a flow of air through the cooking portion 13 of the casing that has a uniform speed so as to effect a relatively high thermal yield in the oven that homogenously and satisfactorily cooks the food within the oven.

To assist the oven in efficiently combusting the gas, an exhaust device is provided which includes, for example as shown in FIG. 2, a circular housing 44 and a fan means 43 (blower) disposed in the housing 44. A housing pipe 46 is connected and open to the housing 44 at the exhaust side of the fan means 43, and the housing pipe 46 is in communication with the exhaust pipe 28 at an end thereof which extends through an exhaust opening 45 provided in the casing 12.

The housing pipe 46 forms a right angle so that a terminal portion 47 thereof extends through the exhaust opening 45, is concentric to the exhaust pipe 28, and is tapered toward the free end of the exhaust pipe 28 so as to form an ejector 48 which aspirates combustion gases through the exhaust pipe 28 in the following manner.

When the fan means 43 is rotated, it exhausts air in the direction of the arrow C toward the outside of the oven through the ejector 48 thereby generating an aspirating effect on the exhaust pipe 28 which draws the combustion gases through the exhaust pipe 28 from the circular pipe 27 of the second collector chamber 26 and the tubes 36 of the heat exchanger 25.

The aspirating effect of the ejector 48 also acts on the gas burner of the first collector 24 to maintain an efficient combustion of the flames all along the burner.

The provision of the ejector 48, in short, allows the combustion gases to be directly discharged from the oven without passing through the fan means 43 so that conventional blowers may be used as the fan means 43 as well as blowers that are designed to resist high thermal loads. Furthermore, a control panel of the oven (not shown) is disposed adjacent the fan means 43 so that the fan means 43 can be used to cool the control panel due to a ventilation effect created by the circulation of air by the fan means 43.

By using an exhaust device having the configuration described above, a plurality of ovens may be operatively associated with one another in series. On the other hand, conventional ovens provided with exhaust flues defined above the cooking portion of the oven cannot be directly operatively associated with one another.

Also, according to the present invention, the tubes 36 can have different shapes and can be provided in different quantities than those described as along as their respective ends 37 and 38 are respectively in communication with the first collector 24 comprising the gas burner, i.e. confronting the openings 34, and the circular pipe 27 of the second collector chamber 26.

Furthermore, as an alternative to the diffuser 40, one or more small plates (not shown) can be welded to the legs of the tubes 36 so as to adequately direct the flow of air forced outwardly by the blower means 17.

Figure 4:
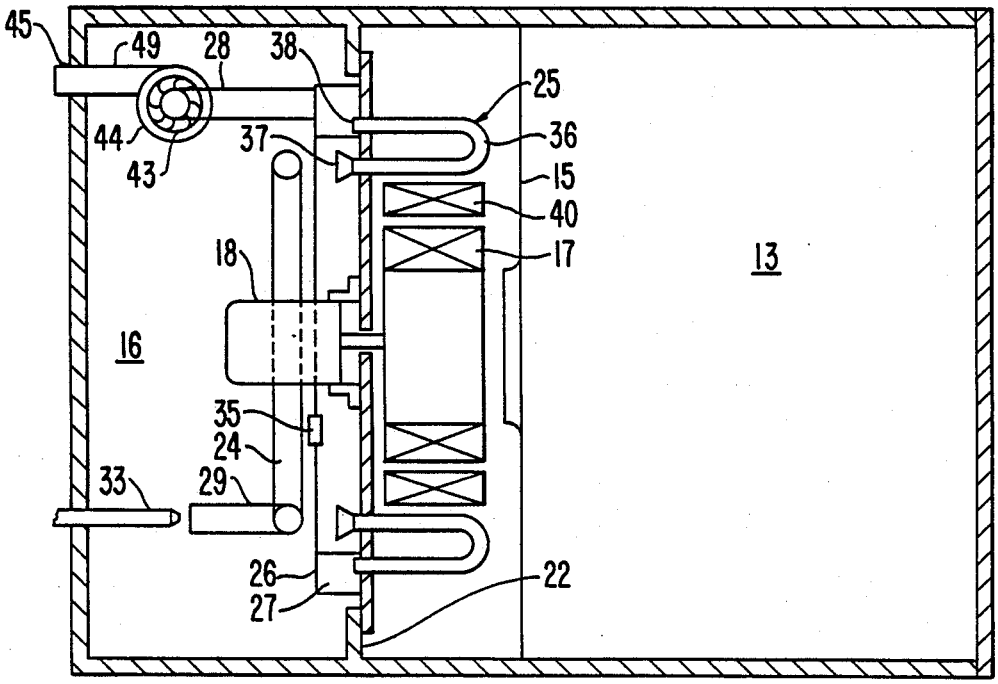
FIG. 4 is a schematic side view, in section, of a second embodiment according to the present invention.

Turning now to FIG. 4, showing a second embodiment according to the present invention, this embodiment is substantially the same as the first embodiment and accordingly, like elements are designated with corresponding reference numerals throughout this figure as well as the remainder of the figures.

In this embodiment, the exhaust device still includes a circular housing 44 and a fan means 43 disposed in the housing 44. However, the fan means 43 is directly connected with the exhaust pipe 28, and a rectilinear pipe 49 extends from the housing 44 through the exhaust opening 45 to the exterior of the oven.

Therefore, the ejector of the first embodiment is obviated and the exhaust gas is exhausted by the fan means 43 directly therethrough. As such, the fan means 43 must be designed so as to resist the thermal load imparted by the high temperature of the combustion gases.

Figure 5:
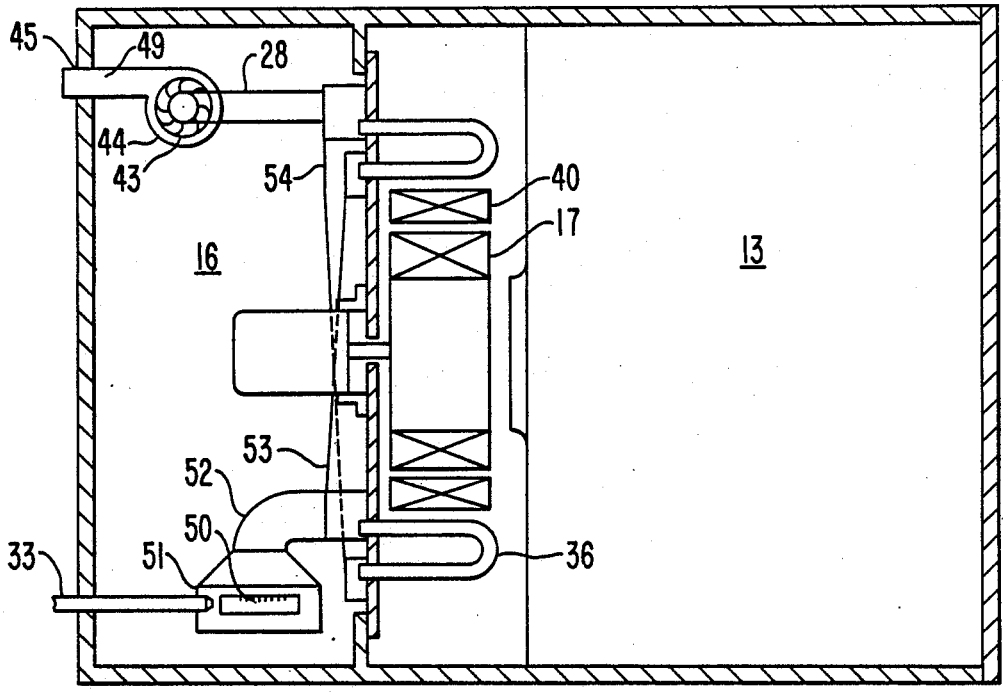
FIG. 5 is a schematic side view, in section, of a third embodiment according to the present invention.

In another embodiment shown in FIG. 5, the oven is provided with a conventional gas burner 50, and the generally annular first collector chamber 53 includes an annular portion, and a combustion chamber portion 51 open to the annular portion, the gas burner 50 being disposed in the combustion chamber portion 51. The combustion chamber 51 is disposed in a lower portion of the heating element-receiving portion 16 of the casing 12 and is connected to the annular portion of the first collector chamber via a pipe 52. The annular portion of the first collector chamber 53 is disposed concentrically inside the second collector chamber 54.

More specifically, as in the previous embodiments, the first and second collector chambers 53, 54 are placed in communication with each other via the tubes 36 of the heat exchanger which operate in the manner described above. The second collector chamber 54 and the annular portion of the first collector chamber 53 each has a cross-sectional area that decreases symmetrically as taken therearound (tapers) in opposite directions from a respective location thereon. In FIG. 5, these locations are defined at the top of the second collector chamber 54 and at the bottom of the annular portion of the first collector chamber 53, respectively. In the FIG. 5 embodiment, the exhaust device is the same as that shown in and described above with respect to FIG. 4.

Figure 6:
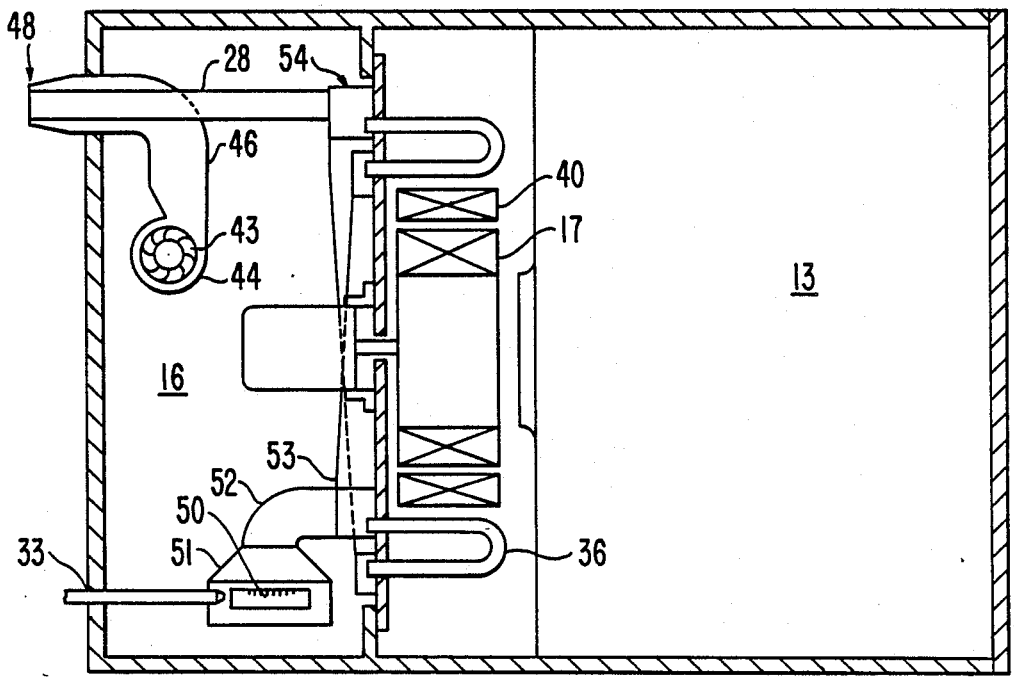
FIG. 6 is a schematic side view, in section, of another embodiment according to the present invention.

In the embodiment of FIG. 6, the oven is essentially the same as that of the FIG. 5 embodiment with the exception of the exhaust device which employs an ejector 48 that is identical in form and operation to that described in the FIG. 2 embodiment.

Figure 7:
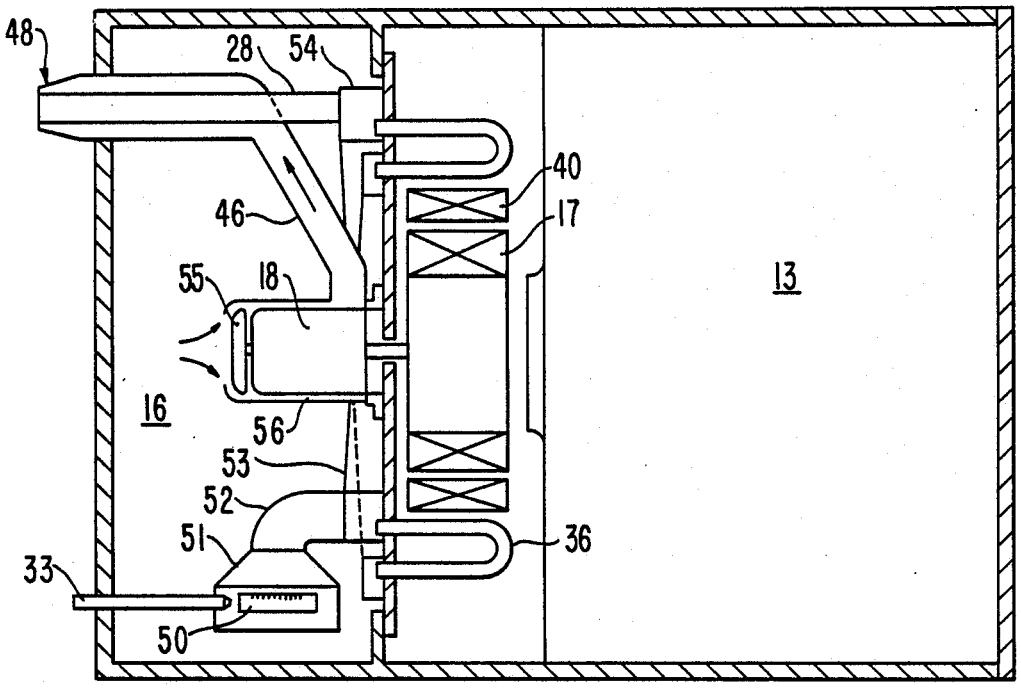
FIGS. 7–9 are each schematic side views, in section, of further embodiments according to the present invention.

Turning now to FIG. 7, showing yet another embodiment of the present invention, the fan means of the exhaust device in this embodiment comprises a fan 55 which is operatively connected to the electric motor 18 so as to be driven by the motor and is disposed relative to the motor so as to cool the motor when driven. The fan 55 is enclosed in a circular housing 56 extending around the motor 18. The housing pipe 46 is connected and open to the housing 56 at the exhaust side of the fan 55 and is in communication with the exhaust pipe 28 at a free end thereof. As in the FIG. 2 embodiment, the housing pipe 46 has a tapered terminal end extending around the exhaust pipe 28 at the open end thereof so as to constitute an ejector 48 for aspirating exhaust gas through the exhaust pipe 28 when the fan 55 is driven.

Figure 8:
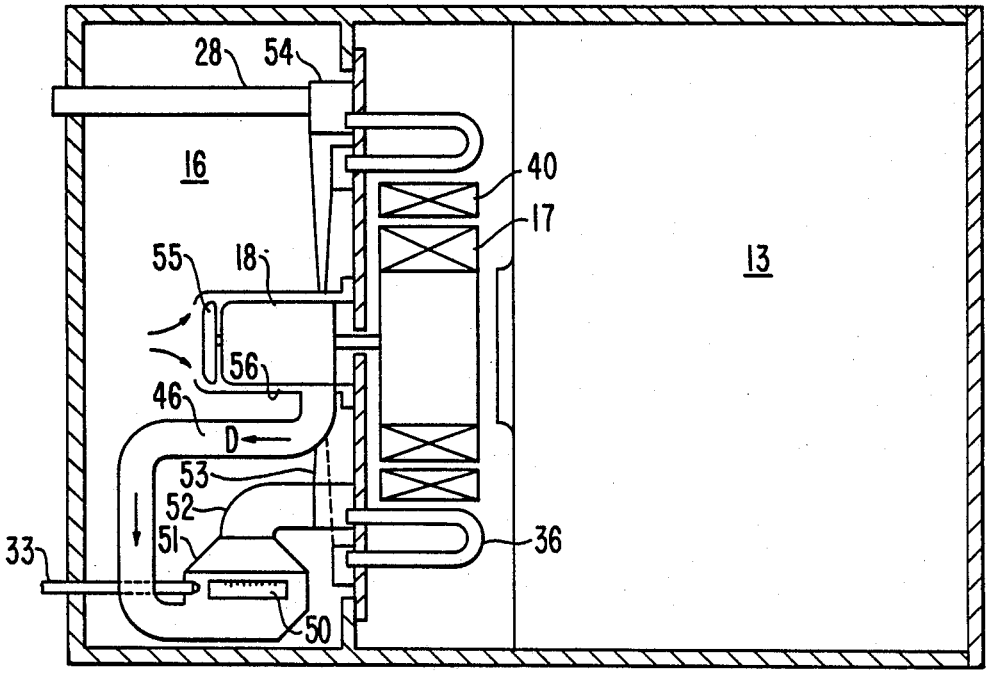

In the embodiment shown in FIG. 8, the housing pipe 46 open to the housing 56 in which the fan 55 is disposed, is connected and open to the combustion chamber portion 51 in which the gas burner 50 is disposed. The fan 55 therefore forces air in the direction of arrow D so as to effect an efficient combustion of the gas in the gas burner 50 and a consequent exhaust of the combustion gases through the generally annular first collector chamber 54 and exhaust pipe 28, without requiring a separately driven fan means and an ejector.

Figure 9:
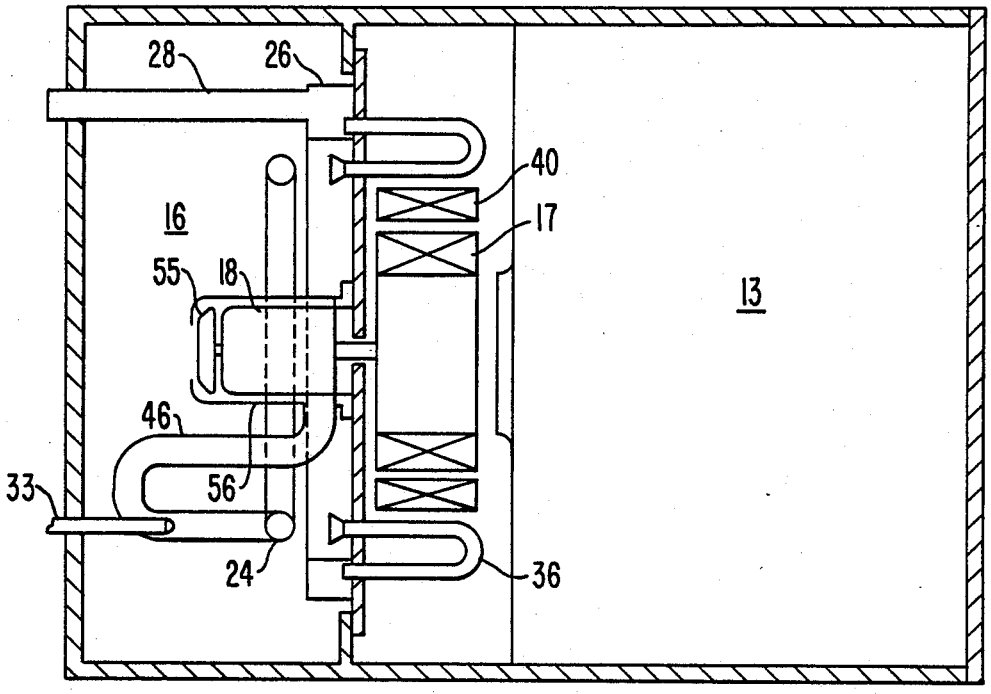

Referring now to FIG. 9, showing yet another embodiment according to the present invention, this embodiment is similar to the FIG. 8 embodiment with the exception that a gas burner as part of the generally annular first collector chamber 24 is provided as in the embodiment of FIGS. 1–3. In this embodiment, the housing 56 in which the fan 55 is disposed is connected with the first collector chamber 24 via the housing pipe 46, and the fan 55 performs the same operation as in the FIG. 8 embodiment.

Figure 10:
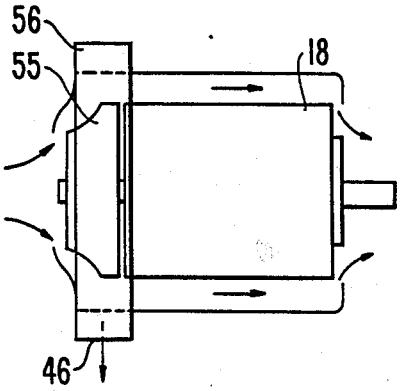
FIGS. 10 and 11 are, respectively, schematic side and front views of a modified feature of the present invention that is applicable to the embodiments shown in FIGS. 7–9.
Figure 11:
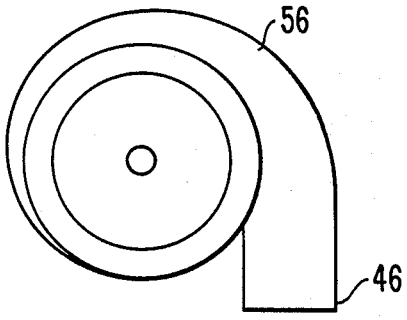

Finally, referring to FIGS. 10 and 11, a modified structure of the housing 56 is shown which can be applied to any of the exhaust devices described with reference to the embodiments of FIGS. 7–9. In this structure, the housing 56 defines a spiral chamber open to the housing pipe 46 and which housing pipe 46 can terminate to form an ejector 48, or can be connected to a combustion chamber portion 51 of a first collector chamber 53 or to a first collector chamber 24 comprising a gas burner.

The principle behind the gas convection oven of the present invention can be adapted to electric ovens as well by providing suitable heating elements having a circular shape and arranging the same in place of the tubes of the heat exchanger and collector chambers in the gas oven described.

Finally, it is to be understood that various changes and modifications will become apparent to those of ordinary skill in the art from reviewing the present specification. All such changes which fall within the scope of the appended claims are seen to constitute the true spirit and scope of the present invention unless otherwise departing therefrom.

What is claimed is:

1. A gas convection oven comprising:

a metallic casing;

a dividing wall disposed in said casing and dividing said casing into a cooking portion in which portion food is to be cooked in the oven and a heating element-receiving portion, said dividing wall defining openings which place the cooking portion of said casing in an air-circulatable relationship with the heating element-receiving portion of said casing;

a generally annular first collector chamber comprising a gas burner connectable to a source of gas for burning gas in the oven and for distributing hot combustion gases over an annular zone in the oven, said first collector chamber disposed in the heating element-receiving portion of said casing;

a generally annular second collector chamber extending concentrically to said first collector chamber within the heating element-receiving portion of said casing;

blower means disposed in the heating element-receiving portion of said casing for forcing air outward from said blower means so as to circulate through said casing between said heating element-receiving and said cooking portions thereof via the openings defined by said dividing wall;

an electric motor operatively connected to said blower means for driving said blower means, said electric motor disposed in the heating element-receiving portion of said casing;

a heat exchanger disposed in the heating element-receiving portion of said casing, said heat exchanger comprising a plurality of tubes disposed outwardly of said blower means and uniformly spaced apart in a symmetrical relationship concentric to said blower means, each of said tubes having a first end in open communication with said first collector chamber so as to receive hot combustion gases generated by said gas burner and a second end in open communication with said second collector chamber; and an exhaust device connected to said second collector chamber for exhausting combustion gases generated by said gas burner from said oven via said second collector chamber and the tubes of said heat exchanger.

2. A gas convection oven as claimed in claim 1, wherein each of said generally annular collector chambers comprises a circular pipe, and said plurality of tubes are generally U-shaped.

3. A gas convection oven as claimed in claim 1, wherein said first collector chamber defines a plurality of apertures through which gas is fed and burnt so as to constitute said gas burner, said apertures uniformly distributed over said first generally annular collector chamber and confronting the first ends of the tubes of said heat exchanger.

4. A gas convection oven as claimed in claim 1, wherein said exhaust device includes an exhaust pipe extending linearly from and in communication with said second collector chamber.

5. A gas convection oven as claimed in claim 1, wherein said first collector chamber includes an annular portion and a combustion chamber portion open to said annular portion, said gas burner being disposed in said combustion chamber portion, said second collector chamber and the annular portion of said first collector chamber each have a cross-sectional area that decreases symmetrically as taken therearound in opposite directions from a respective location thereon, and said exhaust device includes an exhaust pipe extending linearly from and in communication with said second collector chamber.

6. A gas convection oven as claimed in claim 4 or claim 5, wherein said exhaust device includes a housing, a fan means disposed in said housing for exhausting air, and a housing pipe connected and open to said housing at the exhaust side of said fan means, said housing pipe in communication with said exhaust pipe.

7. A gas convection oven as claimed in claim 6, wherein said housing pipe has a tapered terminal end extending around said exhaust pipe at an open end thereof for aspirating combustion gases through said exhaust pipe when said fan means is driven.

8. A gas convection oven as claimed in claim 4 or claim 5, wherein said exhaust device further comprises a housing open to said exhaust pipe, fan means disposed in said housing, and a rectilinear pipe extending from said housing and open to the exterior of said oven.

9. A gas convection oven as claimed in claim 7, wherein said fan means is a fan operatively connected to said electric motor so as to be driven by said motor and disposed relative to said moor so as to cool said motor when driven.

10. A gas convection oven as claimed in claim 6, wherein said first collector chamber includes an annular portion and a combustion chamber portion open to said annular portion, said gas burner being disposed in said combustion chamber portion, said second collector chamber and the annular portion of said first collector chamber each have a cross-sectional area that decreases symmetrically as taken therearound in opposite directions from a respective location thereon, and said exhaust device includes an exhaust pipe extending linearly from and in communication with said second collector chamber, and said housing pipe is also connected and open to said combustion chamber portion.

11. A gas convection oven as claimed in claim 2, wherein said exhaust device includes a housing, a fan disposed in said housing, operatively connected to said electric motor so as to be driven by said motor, and disposed relative to said motor so as to cool said motor when driven, and a housing pipe connected to and open between said housing at the exhaust side of said fan and said gas burner.

12. A gas convection oven as claimed in claim 6, wherein said housing defines a spiral chamber open to said housing pipe.

13. A gas convection oven as claimed in claim 1, wherein said blower means includes a plurality of blades inclined in one of a clockwise and a counterclockwise direction relative to a radially outward direction with respect to said blower means, and further comprising a circular diffuser extending between said blower means and the tubes of said heat exchanger for diffusing air forced outwardly by said blower means over the tubes of said heat exchanger, said diffuser comprising a plurality of wings distributed uniformly about said blower means, said wings being inclined in the other of the clockwise and the counterclockwise directions relative to said radially outward direction.

14. A gas convection oven as claimed in claim 13, wherein said casing includes a support portion extending therein, and further comprising a mounting wall to which said blower means, said electric motor, said heat exchanger, said first and said second collector chambers and said diffuser are mounted in the oven, said mounting wall attached to said casing at said support portion thereof.

15. A module of a gas convection oven comprising:

a mounting wall;

a generally annular first collector chamber mounted to said mounting wall, said first collector chamber comprising a gas burner connectable to a source of gas for burning gas and for distributing hot combustion gases over an annular zone;

a generally annular second collector chamber mounted to said mounting wall and extending concentrically to said first collector chamber;

blower means mounted to said mounting wall for forcing air outwardly therefrom;

an electric motor mounted to said mounting wall and operatively connected to said blower means for driving said blower means; and a heat exchanger mounted to said mounting wall, said heat exchanger comprising a plurality of generally U-shaped tubes disposed outwardly of said blower means and uniformly spaced apart in a symmetrical relationship with respect to said blower means, each of said tubes having a first end in open communication with said first collector chamber and a second end in open communication with said second collector chamber.

16. A module as claimed in claim 15, and further comprising a circular diffuser mounted to said mounting wall and extending between said blower means and the tubes of said heat exchanger for diffusing air forced outwardly by said blower means over the tubes of said heat exchanger.

17. A module as claimed in claim 16, wherein said blower means includes a plurality of blades inclined in one of a clockwise and a counterclockwise direction relative to a radially outward direction with respect to said blower means, and said diffuser comprises a plurality of wings distributed uniformly about said blower means, said wings being inclined in the other of the clockwise and counterclockwise directions relative to said radially outward direction.

* * * * *